United States Patent [19]

Montgomery

[11] Patent Number: 4,923,194

[45] Date of Patent: May 8, 1990

[54] INCLINED EXERCISE BAR SYSTEM

[76] Inventor: Calvin W. Montgomery, 4 Baynard Cove Rd., Hilton Head, S.C. 29928

[21] Appl. No.: 333,917

[22] Filed: Apr. 6, 1989

[51] Int. Cl.[5] ..... A63B 21/00

[52] U.S. Cl. ..... 272/93; 272/63; 272/123

[58] Field of Search ..... 272/62, 63, 93, 109, 272/112, 113, 116, 117, 123, 144; 248/163.1, 165; D21/193–198

[56] References Cited

U.S. PATENT DOCUMENTS

| | | | |
|---|---|---|---|
| 215,164 | 9/1969 | Wormser | D21/3 |
| D. 287,526 | 12/1986 | Brockett et al. | D21/197 |
| D. 290,485 | 6/1987 | Suponitsky | D21/198 |
| 2,788,971 | 4/1957 | Berne | 272/63 |
| 3,235,255 | 2/1966 | Leflar | 272/123 |
| 3,891,207 | 6/1975 | Helliwell | 272/62 X |
| 3,920,240 | 11/1975 | Ross . | |
| 4,018,437 | 4/1977 | Lopresti | 272/62 |
| 4,369,966 | 1/1983 | Silberman et al. | 272/62 |
| 4,666,154 | 5/1987 | Lipscomb et al. | 272/144 |
| 4,757,998 | 7/1988 | Landin | 272/123 |
| 4,773,642 | 9/1988 | Cruz | 272/123 |

FOREIGN PATENT DOCUMENTS

| | | | |
|---|---|---|---|
| 2076299 | 12/1981 | United Kingdom | 272/144 |

*Primary Examiner*—Robert W. Bahr

*Attorney, Agent, or Firm*—Fleit, Jacobson, Cohn, Price, Holman & Stern

[57] ABSTRACT

A pull-up or push-up exercise device includes two bars having parallel inclined portions. A transverse cross bar is secured between the two bars and slidably mounted to vary the height of the cross bar on the inclined portion of the two bars. Two platforms hold the cross bar on the exercise bars. The cross bar is in a "W" configuration to provide slanted gripping portions for a natural hold without wrist strain throughout pull-up and push-up exercise.

19 Claims, 7 Drawing Sheets

INCLINED EXERCISE BAR SYSTEM

FIELD OF THE INVENTION

This invention includes two parallel bars forming an inclined exercise surface and having a cross bar extending transverse to the two parallel bars. The cross bar is slidably mounted on the parallel bars for adjusting the height from the ground of the hands of the operator when the operator performs push-ups or pull-ups from the cross bar.

BACKGROUND OF THE INVENTION

The trend toward physical fitness has increased tremendously in popularity over recent years. The popularity of exercise has become a social activity at health clubs as well as being a benefit in maintaining the medical/physical well-being of an individual.

However, some common exercises such as push-ups and pull-ups are not able to be performed by everyone in the traditional sense. Push-ups are usually performed by placing one's toes and hands on the grounds with the body being held in a stiff position. By exertion of the arms to push the body away from the ground by a full extension of the arms and a return toward the ground by bending of the arms, a push-up is accomplished. Similarly, a pull-up is accomplished by hanging vertically from a horizontal bar sufficiently high above the ground so that when the bar is held by the hands, the body of the individual is suspended in the air. By pulling one's body to a height, usually so the head of the person extends above the horizontal bar and return of the body to a relaxed hanging position, a pull-up is accomplished.

SUMMARY OF THE PRESENT INVENTION

By the present invention, a pull-up or push-up may be performed at different points along inclined parallel bars. A "diagonal" push-up is a milder form of push-up since one is not lifting the body at 90° or perpendicular to the floor and therefore not encountering the full force of gravity. The further up the incline of the parallel bars that the hands are placed on a transverse cross bar during a push-up, the more one gets away from the full 90° pull of gravity and therefore less exertion is required. Since a diagonal push-up is a much milder form of exercise than a regular push-up, the invention allows young people to be able to do push-ups and gain the advantage and self-esteem of doing some type of push-up exercise. This variance on the amount of exertion for a push-up is also helpful for adults who want to vary the degree of difficulty of repetitive exercise.

Similarly, a "horizontal" pull-up is done simply by laying down between two parallel inclined bars and grasping a transverse cross bar at a point where the hands contact the bar when the arms are in a fully straightened position. Keeping the back straight and feet together, the arms are bent to lift the body off of the ground towards the cross bar, thus performing a horizontal pull-up. During the exercise, the end portions of the bars are pulled against the floor with enough force to prevent the bars from moving. A horizontal pull-up is a much milder form of exercise than a standard vertical pull-up since one is not lifting their entire body off of the ground. This affords more young people an opportunity to accomplish pull-ups and gain the advantage and self-esteem of doing pull-up exercise. Similarly, the position at which the hands contact the cross bar of the inclined parallel bars may be varied to increase or decrease the difficulty encountered by adults in repetitive pull-up exercise.

An adjustable transverse cross bar is slidably mounted on the two parallel inclined bars to allow a more standard pull-up type grip or barbell-type grip for pull-ups and push-ups. Rubberized portions on the transverse bar allow the transverse bar to be gripped on both sides of each of the two inclined parallel bars so that no slippage occurs during exercise. The transverse bar may be removed from the two parallel inclined bars when not in use.

The transverse bar may be of a "W" configuration. The W-bar's slanted gripping portion gives a more natural hold without wrist strain throughout pull-up and push-up exercise. The W-bar is suspended on the two main parallel inclined bars with rubber or plastic bumpers or sleeves which fit and hug the two parallel inclined bars when force is exerted downward as during push-up or pull-up exercising. On top of the bumper rods is a platform where the W-bar rides and is held in place by an upper spring loop. The upper loop above the W-bar allows the W-bar to remain fixed to the platform but also allows sufficient room for the W-bar to be flipped over to choose a different type hold on the W-bar.

Two lower spring loops beneath each platform connect each of the bumper rods to the two main parallel inclined bars. These lower loops help guide the bumper rods to remain parallel to the main rods and also keeps the W-bar from being lifted off the main bar. When the W-bar is lifted, the lower loops contact the lower surface of the two inclined parallel bars and the rubber bumpers are lifted off the top surface of the parallel bars so that the entire W-bar unit may be slid up or down along the inclined parallel bars to a desired position.

Since the slanted gripping portions of the W-bar are spaced laterally apart from the pivot point of the W-bar, a stop is affixed to the W-bar. This stop rides on top of the rubber bumpers and does not allow the W-bar handles to rotate beyond a predetermined point. Four different gripping positions are created by the W-bar being able to flip over into two different settings with a different inside grip and outside grip per setting.

An adjustable sit-up bar is created by a bar having brackets pivotably mounted on two studs secured to the hollow tubes of the base. This bar may be raised to slide the feet under the bar or lowered to be out of the way. A securing bolt runs through one of the two brackets to secure the bar to the studs used to hold the sit-up bar in place.

A foot-rest attachment is used in combination with the exercise bars. The foot-rest attachment includes two identical tracks or sides with support holes drilled or punched therein. The support holes allow the feet of the diagonal exercise bars to sit in the holes to keep the foot-rest from sliding during exercise. A plate is welded to the inside ends of each of the tracks and between these plates a foot-rest portion is attached at approximately a 45° angle and approximately two inches from the floor. During exercise, the soles of the shoes or feet rest against the foot-rest portion and provide 100% foot support. A pull-back bar is welded between the tracks at a distance approximately six inches to one foot behind the foot-rest portion. The pull-back bar allows the heels to move the entire foot-rest unit back while the hands are lifting the diagonal exercise bars so that they might be placed in different support holes.

The W-bar allows one's body weight to be used safely and efficiently instead of machine weights and barbells. The W-bar's push and pull-up exercises are done with the body in a relatively horizontal position and are therefore much less likely to cause lower back or groin injuries common with lifting heavy weights. The W-bar is a safe alternative for upper body workouts in schools, nursing homes, dormitories, physical therapy units and households.

It is an object of the present invention to provide an exercise bar for performing diagonal push-ups and horizontal pull-ups.

It is another object of the present invention to provide an exercise bar for performing diagonal push-ups and horizontal pull-ups wherein two exercise bars are spaced from one another and include an inclined portion which is held by one performing an exercise.

It is yet another object of the present invention to provide an exercise bar for performing diagonal push-ups and horizontal pull-ups wherein two exercise bars are spaced from one another and include an inclined portion, which is held by one performing an exercise, and a transverse cross bar extends between the two exercise bars to facilitate different gripping portions to assist in performing exercise.

It is still yet another object of the present invention to provide an exercise bar for performing diagonal push-ups and horizontal pull-ups wherein two exercise bars are spaced from one another and include an inclined portion, which is held by one performing an exercise, and a transverse cross bar extends between the two exercise bars to facilitate different gripping portions to assist in performing exercise, and the cross bar is in a "W" shaped configuration.

These and other objects of the invention, as well as many of the attendant advantages thereof, will become more readily apparent when reference is made to the following description taken in conjunction with the accompanying drawings.

BRIEF DESCRIPTION OF THE PREFERRED EMBODIMENTS

Figure 1:
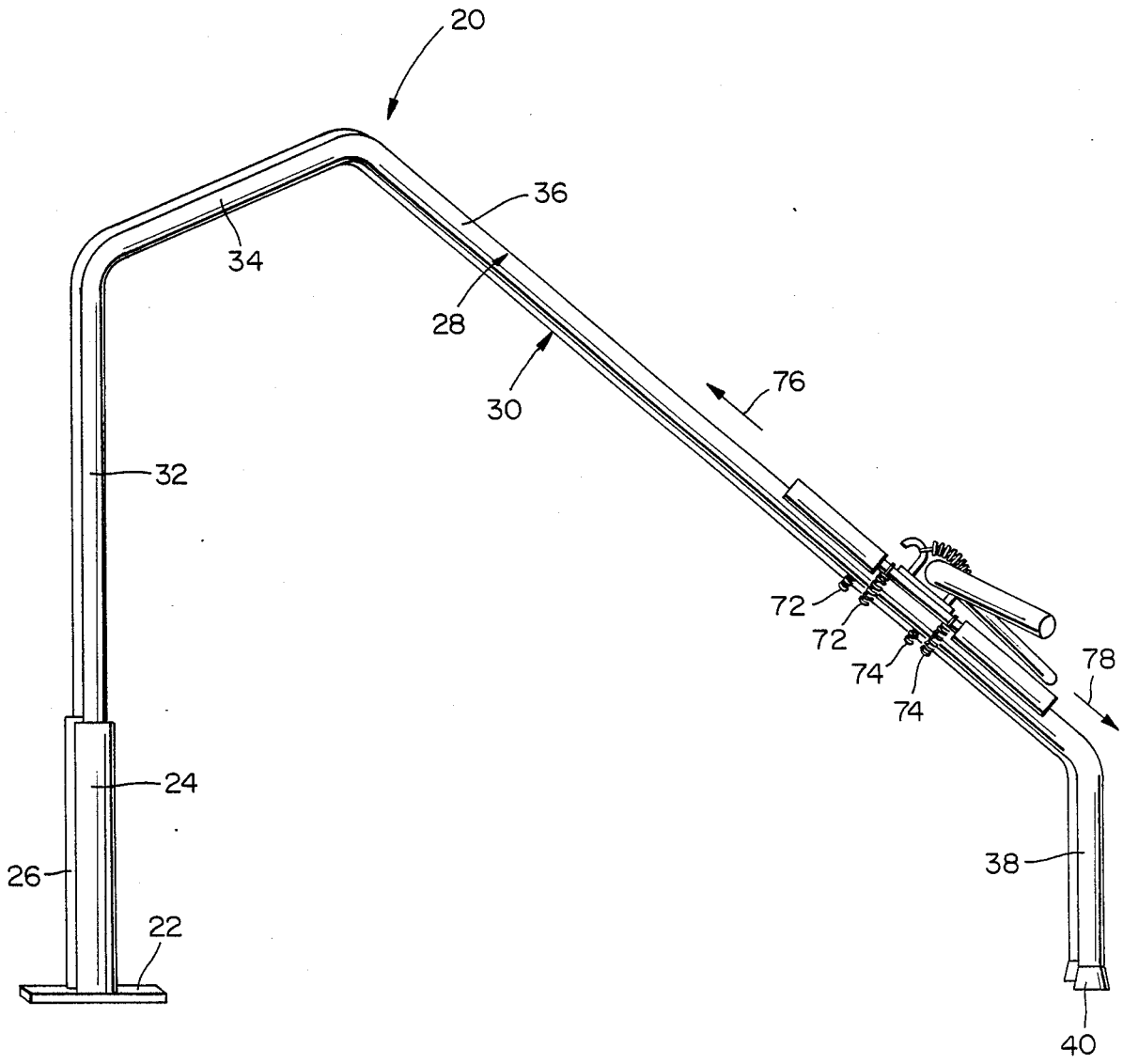
FIG. 1 is a perspective view of two parallel exercise bars and a transversely extending W-bar.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
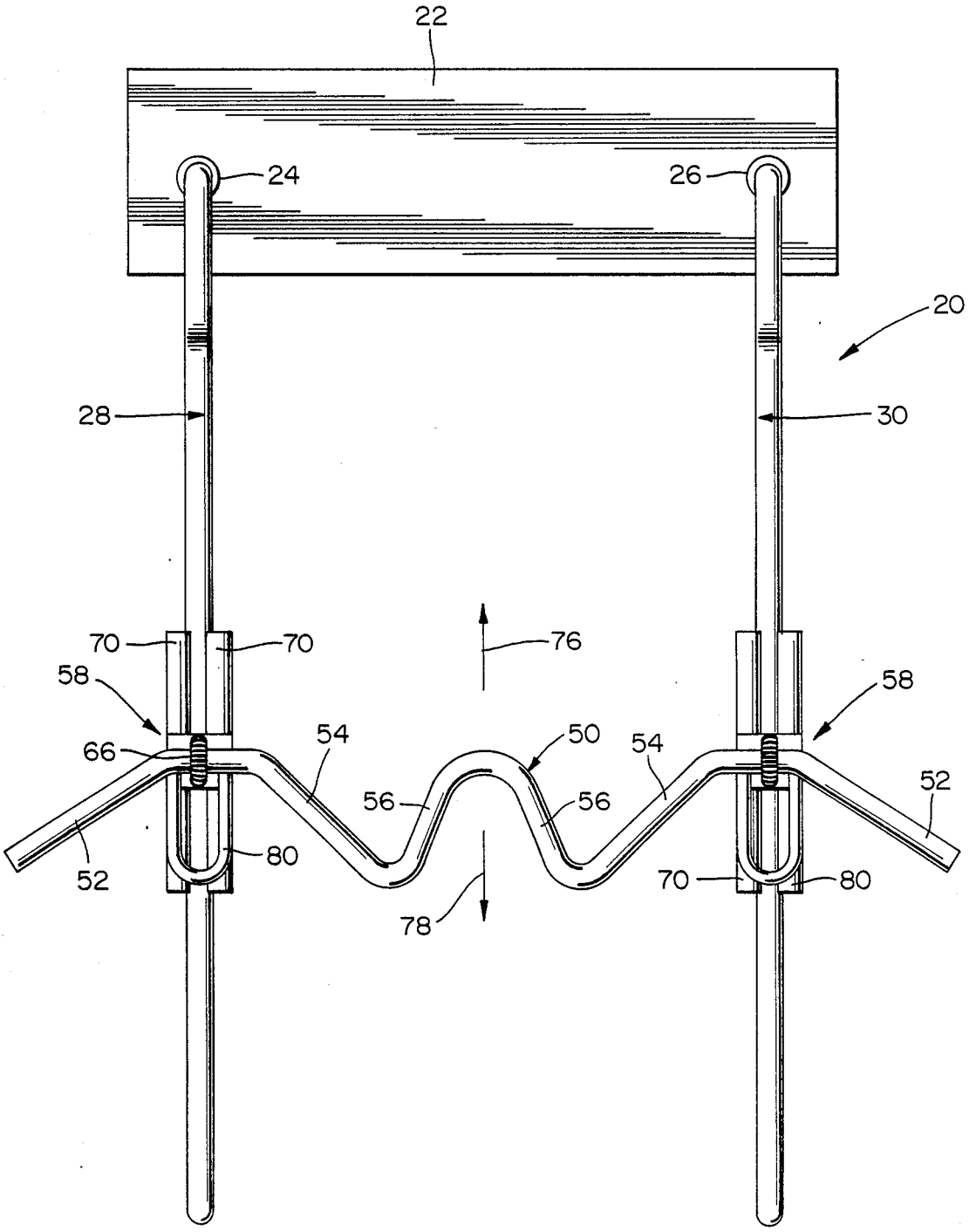
FIG. 2 is a plan view of the two parallel exercise bars and transverse W-bar slidably mounted thereon.

With reference to the drawings, in general, and to FIGS. 1 and 2 in particular, an inclined exercise device embodying the teachings of the subject invention is generally designated as 20. With reference to its orientation in FIG. 1, the exercise device includes a base 22 having two parallel hollow tubes 24 and 26 extending vertically from the base. Mounted within each of the tubes 24 and 26 are two identical bent exercise bars 28 and 30, respectively.

Each of the exercise bars 28, 30 includes a vertically rising portion 32 which is connected to inclining tapered portion 34 which is connected to inclined portion 36 which terminates in vertically rising portion 38. End 40 of portion 38 rests on the floor. The end of portion 32 is held within tubes 24 and 26, respectively, and rest against the base 22. Between the base 22 and the ends 40 of bars 28 and 30, the exercise device is stably mounted on the floor.

Figure 3:
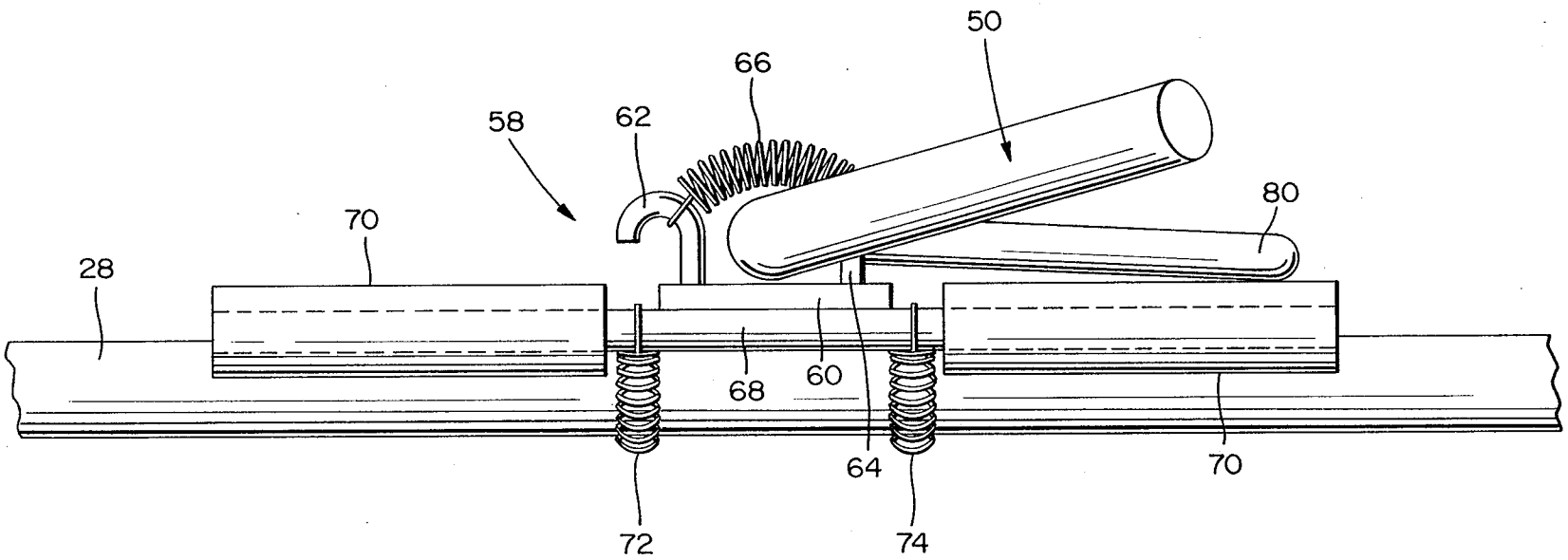
FIG. 3 is a detailed side view of the mounting of the W-bar on one of the two exercise bars.

As shown in FIG. 2, a cross bar 50 is shown extending transversely to exercise bars 28 and 30. The cross bar extends substantially perpendicular to the exercise bars 28 and 30. The cross bar 50 is in a "W" shape configuration. The bar includes three sets of slanted gripping positions 52, 54, and 56, respectively. The cross bar 50 is secured to two platforms 58. The platforms include, as shown in FIG. 3, a flat plate 60 to which two oppositely directed hooks 62 and 64 are secured. An upper loop or spring 66 spans between the hooks 62 and 64 in a direction parallel to bars 28 and 30 to hold the cross bar 50 between the spring 66 and plate 60.

The plate 60 is secured to two parallel rods 68 which have rubber sleeves 70 located on opposite ends of the rods 68. A spacing between the sleeves 70 of the rods 68 is less than the diameter of the bars 28 and 30 such that the sleeves 70 engage and rest on top of the bars 28 and 30.

Lower loops or springs 72 and 74 are wrapped around the bars 28 and 30 and connect spaced apart rods 68. The springs 72, 74 hold the platform 58 in position on each of the rods 28 and 30. However, upon lifting of the platform 58, the tension of the springs 72, 74 allows the platform to be raised slightly from the bars 28 and 30 for sliding of the platform 58, and thereby the cross bar 50, in the direction of arrows 76 and 78 of FIGS. 1 and 2.

Figure 4:
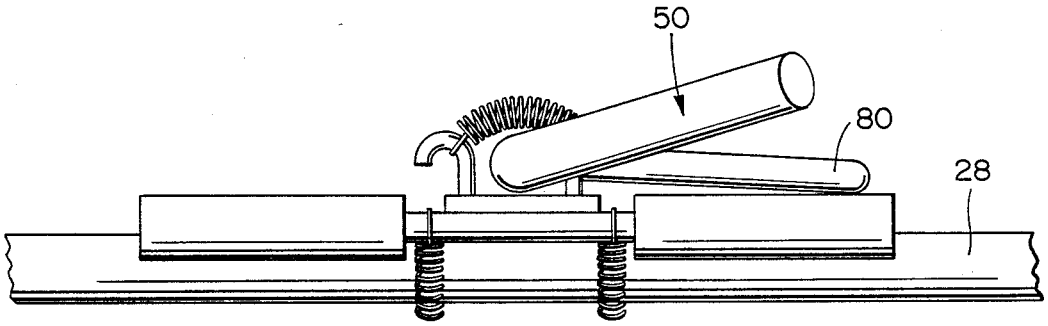
FIG. 4 is a side view of the W-bar mounted on an exercise bar in a first position.
Figure 5:
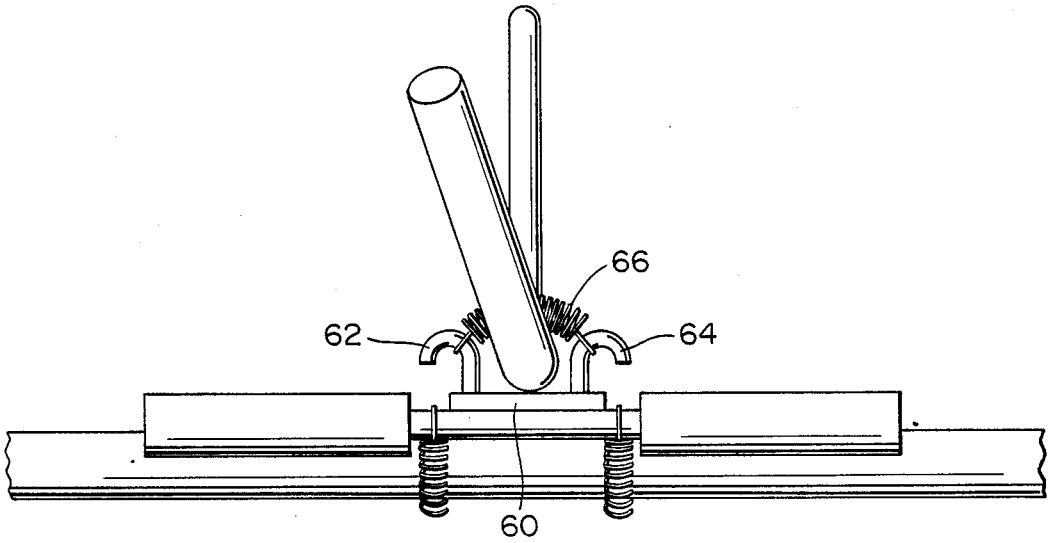
FIG. 5 is a side view of the W-bar being moved from the first position to a second position.
Figure 6:
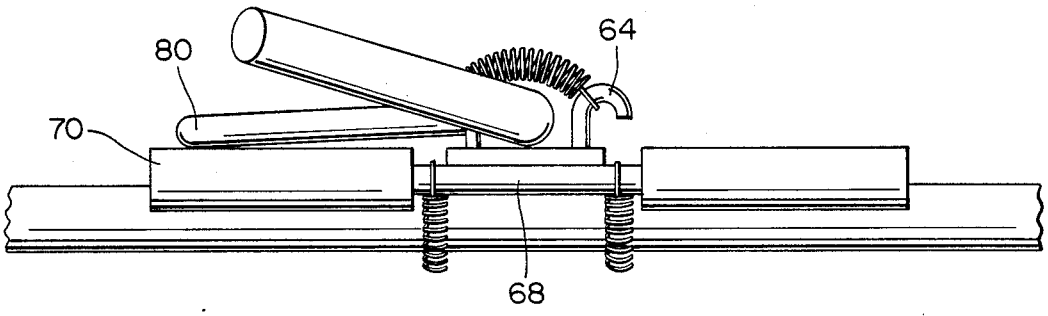
FIG. 6 is a side view of the W-bar in the second position.

To allow the cross bar 50 to be moved between two positions, as shown in FIGS. 4–6, the cross bar includes a U-shaped stop 80 which is secured at the ends of the legs of the U-shaped stop to the cross bar 50. The cross-piece interconnecting the legs of the U-shaped bar contacts the sleeve 70 of the rods 68 to prevent further movement of the cross bar between a first position and a second position.

In FIG. 4, the cross bar 50 is shown in a first position as is also shown in FIGS. 1–3. In this position, the handle portions 52 of the cross bar point towards the portions 38 of the exercise bars 28 and 30. By pulling upwardly slightly on the cross bar 50, against the force of the spring 66, the cross bar is pivoted from the first position to a location as shown in FIG. 5 which is intermediate of the first position and a second position. Upon further rotation, the cross bar 50 is moved into a second position as shown in FIG. 6. In FIG. 6, the handle portions 52 extend in a direction towards the portions 32 of the exercise bars 28 and 30. In the second position, stop 80 similarly contacts the rubber sleeves which extend about the rods 68.

Figure 7:
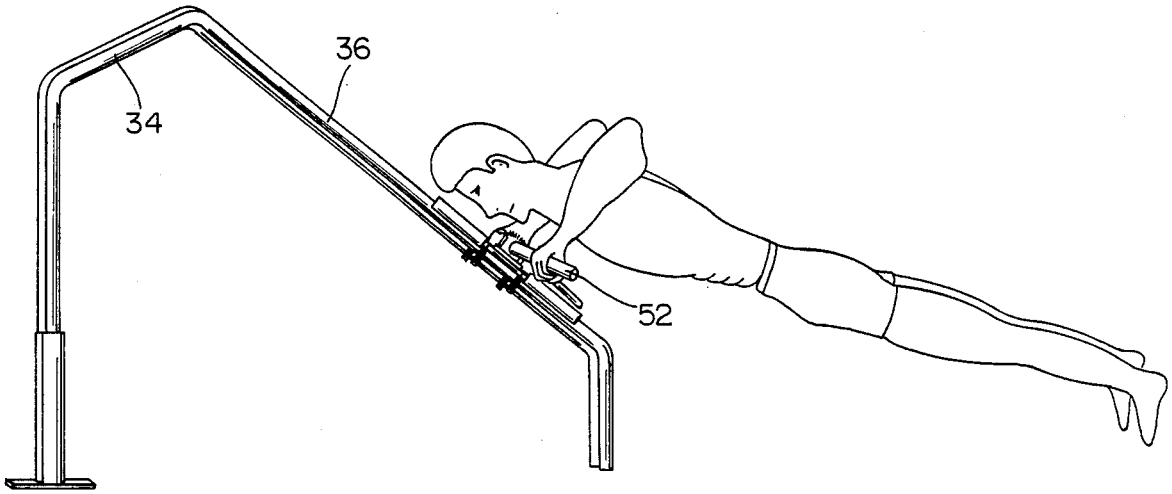
FIG. 7 illustrates the exercise bars being used for an inclined push-up.

In FIG. 7, an operator is shown performing a push-up by grasping handle portions 52 of the cross bar. In the position shown for the mounting bracket 58 for the cross bars, a more difficult push-up is performed compared to a push-up when the cross bar is located closer to the inclined portion 34 of the exercise bars. It is recommended that push-ups be performed on the cross bar grasping the cross bar at either handle portions 52 or handle portions 56 with the wrist of the operator pointed in the direction shown in FIG. 7. An alternate grip would be to grasp handle portions 54 after the cross bar has been turned into the second position shown in FIG. 6 with the wrists of the operator pointing in the same direction as those shown in FIG. 7.

Figure 8:
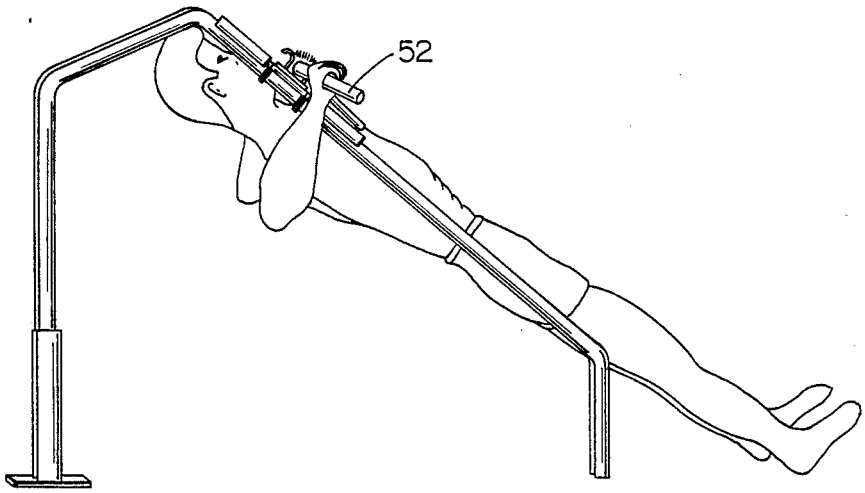
FIG. 8 illustrates the exercise bars being used for a horizontal pull-up.

In performing a pull-up with the cross bar as shown in FIG. 8, the operator can grasp the handle portions 52 with the wrists pointing in the direction shown. Alternately, with the cross bar in the first position as shown in FIGS. 4 and 8, handle portions 56 can be grasped with the wrists in the position shown in FIG. 8 or handle portions 54 grasped with the wrists inverted from the position shown in FIG. 8. When the cross bar is rotated to the second position as shown in FIG. 6, pull-ups may be performed by grabbing handle portions 56 or 52, with the wrists inverted from the position shown in FIG. 8, or handle portions 54 may be grabbed with the wrists in the same direction as shown in FIG. 8.

These are but a few of the uses of the exercise device of the present invention. It is also appreciated that push-up and pull-up type exercises may be performed on the exercise bars 28 and 30 without the assistance of cross bar 50. In this mode of operation, the exercise bars 28 and 30 are pivotably mounted within tubes 24 and 26. Therefore, bars 28 and 30 may be pivoted about the end portions 32 of the bars anchored in the tubes 24 and 26 to vary the distance between the bars 28 and 30. In this embodiment, the bars 28 and 30 are no longer parallel and are free to move towards and away from each other. The advantage of the freedom of movement of the bars 28 and 30 is to provide for different age participants who may require a grip on bars 28 and 30 to be either closer or further away so as to regulate the difficulty involved in performing the exercise. Use of the cross bar 50 eliminates the need for moving of the exercise bars 28 and 30 towards and away from each other since the slanted gripping portions 52, 54 and 56 can accommodate all ages and sizes of individuals.

Figure 9:
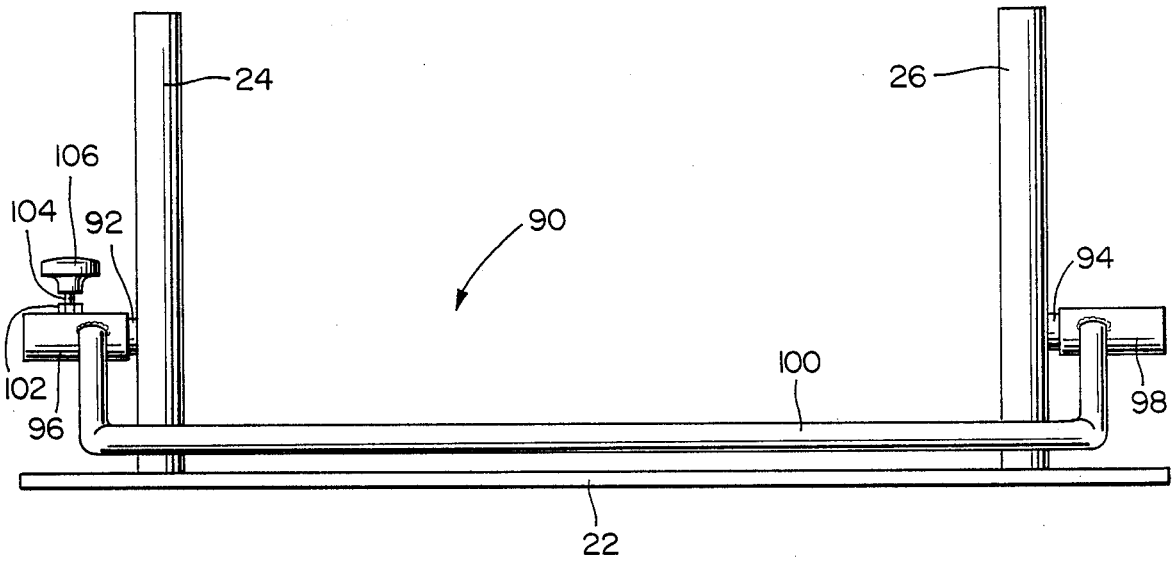
FIG. 9 illustrates a sit-up bar in a non-use position.

In FIG. 9, sit-up bar assembly 90 is shown. Projecting from hollow tubes 24 and 26 are solid studs 92 and 94, respectively. Surrounding the studs 92 and 94 are outer pipes 96 and 98, respectively. Interconnecting the outer pipes 96 and 98 is sit-up bar 100.

Extending through outer pipe 96 is an opening about which a nut 102 has been welded. Passing through the nut 102 in the opening in outer pipe 96 is a threaded shaft 104 having a tightening knob 106 to adjust the sit-up bar 100, the tightening knob 106 is loosened and the bar is pivoted by outer tubes 96 and 98 about studs 92 and 94. Knob 106 is then tightened to contact the stud 92 and thereby lock the sit-up bar in position.

Figure 10:
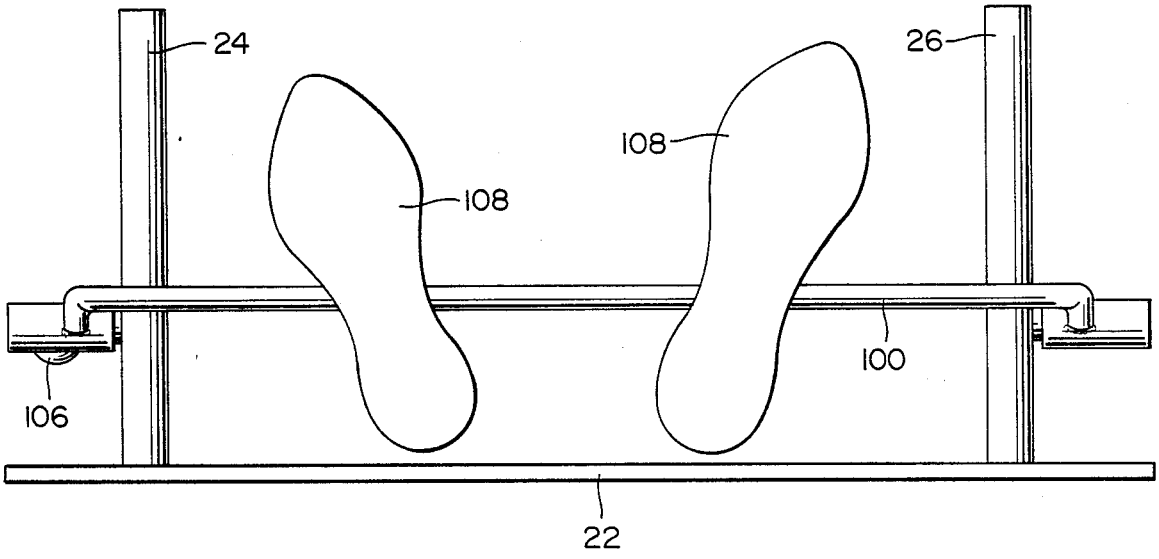
FIG. 10 illustrates the sit-up bar of FIG. 9 pivoted to an in-use position.

In FIG. 10, the feet 108 of the operator are shown hooked under the sit-up bar 100 which is locked in a raised position. This position is suitable for maintaining the feet in a fixed position during sit-up exercise.

Figure 11:
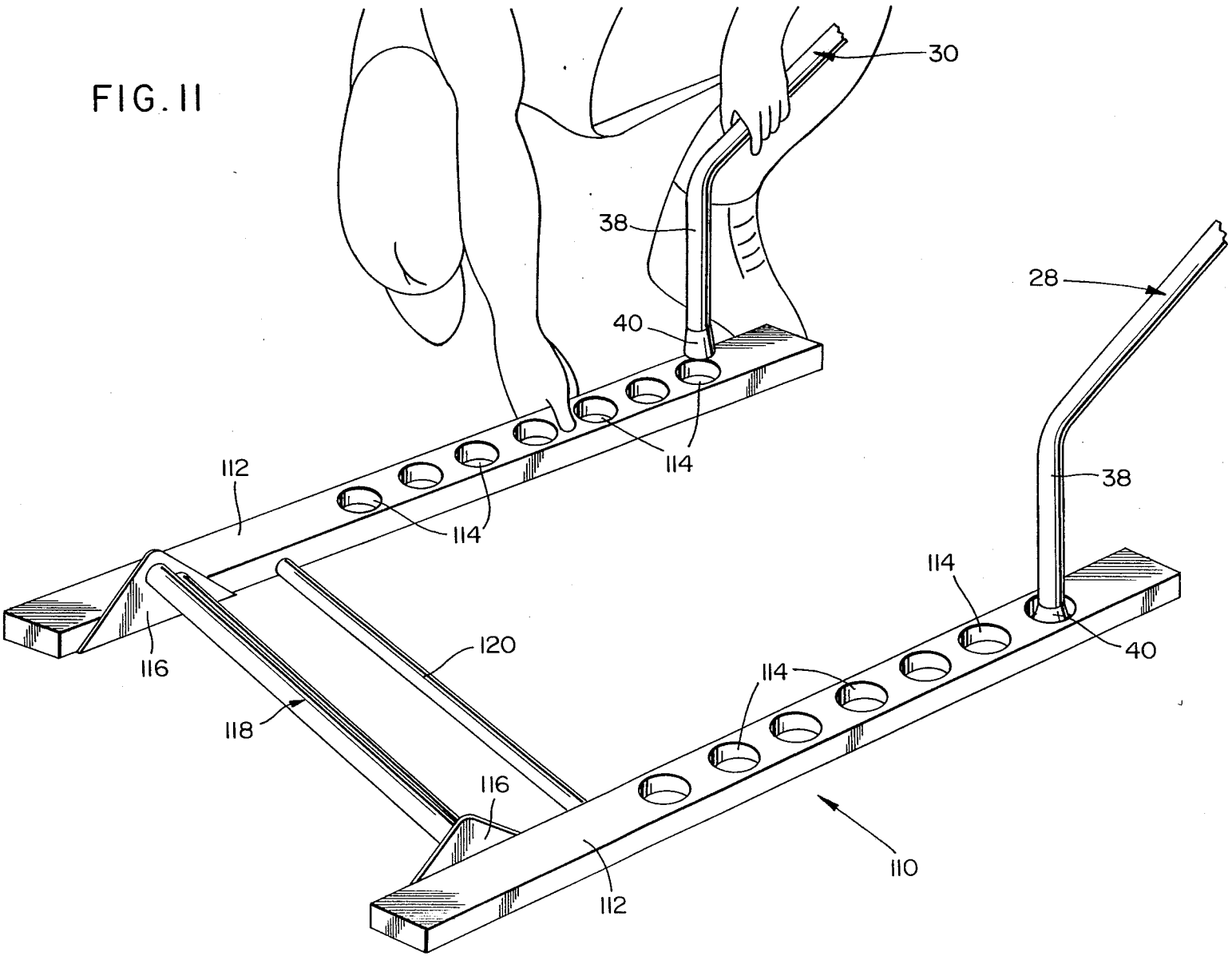
FIG. 11 illustrates a foot-rest attachment for the exercise bars.

In FIG. 11, a foot-rest attachment 110 is shown having two side tracks 112. The side tracks include a plurality of support holes 114 extending through the tracks 112. The support holes receive the ends 40 of sections 38 of the exercise bars 28, 30.

Two plates 116 are welded to the inside ends of each of the tracks 112. Between the plates extend a foot-rest portion 118 attached to the plates to extend approximately at a 45° angle with respect to the floor and at a height of approximately two inches from the floor. During exercise, the soles of the shoes or feet rest against the foot-rest portion 118 to provide foot support. A pull-back bar 120 is welded between the tracks 112 six to twelve inches behind the foot-rest portion 118. The pull-back bar allows the heels to move the entire foot-rest unit while the hands are lifting the exercise bars 28 and 30 so that the ends 40 may be placed in different support holes 114.

Having described the invention, many modifications thereto will become apparent to those skilled in the art to which it pertains without deviation from the spirit of the invention as defined by the scope of the appended claims.

I claim:

1. An exercise bar assembly comprising:

a base adapted to lie on the floor, two bars extending parallel to each other and each having two ends with one end mounted on said base, each of said two bars including an inclined portion, said inclined portion of each of said two bars being spaced apart from each other for performing exercises while the feet of the exerciser are located on the floor, and a symmetrically bent cross bar pivotably mounted on said two bars and including means for limiting rotation of said cross bar to two end positions substantially 180° apart so as to vary the position of gripping of said cross bar by the exerciser as the exerciser performs exercises.

2. An exercise bar assembly according to claim 1, wherein mounting means are slidably mounted on said two bars for locating said cross bar along said two bars.

3. An exercise bar assembly according to claim 2, wherein said mounting means maintain said cross bar extending in a direction substantially perpendicular to said bars.

4. An exercise bar assembly according to claim 1, wherein the other end of said two bars are located on the floor.

5. An exercise bar assembly according to claim 1, wherein the other end of said two bars are located in a foot-rest attachment for resting of the feet of the exerciser during exercise.

6. An exercise bar assembly according to claim 5, wherein said attachment includes two tracks spaced from each other and including a foot-rest portion extending between said two tracks.

7. An exercise device comprising:

a base plate adapted to sit on the floor, two exercise bars extending from said base plate, each of said two exercise bars having two ends and having an inclined portion located between said two ends, and means for pivotably mounting one end of said two bars on said base plate so as to vary the distance between said inclined portions of said two bars and change the difficulty of push-ups and pull-ups being performed on said two bars as said inclined portions are held by an exerciser, said other end of said two bars extending vertically from the floor towards said inclined portion.

8. An exercise device according to claim 7, wherein said means for pivotably mounting anchors one end of each of said two bars on said base plate.

9. An exercise device according to claim 8, wherein said means for mounting include two vertically extending pipes extending from said base plate, said two pipes being spaced from each other.

10. An exercise device according to claim 7, wherein a sit-up bar assembly having a sit-up bar is pivotably mounted on said means for pivotably mounting so that said sit-up bar is movable to a position of use spaced above the floor to allow the feet of the exerciser to be held in a fixed position.

11. An exercise device according to claim 7, wherein said two bars rise vertically from said base plate.

12. An exercise device according to claim 7, wherein the other end of said two bars are located in a foot-rest attachment for resting of the feet of the exerciser during exercise.

13. An exercise device according to claim 12, wherein said attachment includes two tracks spaced from each other and including a foot-rest portion extending between said two tracks.

14. An exercise bar system comprising:

a base, two exercise bars extending parallel to each other and being spaced from each other, said two bars having two ends, one of said two ends being supported by said base, and a cross bar extending transverse to said two bars, overlapping said two bars, and being pivotably mounted on an inclined portion of said two bars, said cross bar being W-shaped to provide three sets of inclined gripping portions and two sets of said gripping portions being located between said two bars and one set of said gripping portions being located beyond said two bars.

15. An exercise bar system according to claim 14, wherein the other of said two ends of said two bars is removably mounted in a foot-rest attachment having a foot rest for supporting the feet of an exerciser during exercise.

16. An exercise bar system according to claim 14, wherein said base is lying on the floor.

17. An exercise bar system according to claim 14, wherein means for mounting said one end of said two bars on said base includes sit-up means for securing the feet of an exerciser between said two bars.

18. An exercise bar system according to claim 2, wherein said cross bar is W-shaped.

19. An exercise bar system according to claim 18, wherein said cross bar includes three sets of inclined gripping portions.

* * * * *